US006464558B1

(12) United States Patent
Ayres

(10) Patent No.: US 6,464,558 B1
(45) Date of Patent: Oct. 15, 2002

(54) SPORTS RELATED COMBINED NOISEMAKER AND VISUAL DISPLAY DEVICE

(76) Inventor: Ronald W. Ayres, 2912 Roy Rd., Tyler, TX (US) 75707

( * ) Notice: Subject to any disclaimer, the term of this patent is extended or adjusted under 35 U.S.C. 154(b) by 0 days.

(21) Appl. No.: 09/687,915

(22) Filed: Oct. 13, 2000

Related U.S. Application Data

(60) Provisional application No. 60/159,468, filed on Oct. 13, 1999.

(51) Int. Cl.[7] ..... A63H 5/00
(52) U.S. Cl. ..... 446/419
(58) Field of Search ..... 446/419

(56) References Cited

U.S. PATENT DOCUMENTS 3,460,830 A * 8/1969 Barlow et al. ..... 446/419 X
3,698,128 A * 10/1972 Moeser ..... 446/419
4,306,485 A * 12/1981 Rudkin ..... 446/419 X
4,454,204 A * 6/1984 Posey ..... 446/419 X
5,199,920 A * 4/1993 Christen ..... 446/419
5,265,514 A * 11/1993 Schertz ..... 446/419 X

* cited by examiner

*Primary Examiner*—John A. Ricci
(74) *Attorney, Agent, or Firm*—Ronald B Sefrna

(57) ABSTRACT

A sports related combined noisemaker and visual display device includes a hollow body with a rigid wall, configured to replicate the appearance of a helmet or other type of sporting equipment, a rigid partition disposed in the interior of the body so as to form a closed chamber bounded by the wall of the body and the partition, a plurality of hard pellets loosely disposed in the chamber, and handle means disposed on the body for shaking the body back and forth to cause the pellets to impact the wall and partition and produce sound. The placement of the handle and the orientation of the partition are such that the chamber functions to focus and project the sound from the wall of the body generally opposite the handle. The outer surface of the body provides an area for the application of visual displays such as decals.

11 Claims, 6 Drawing Sheets

SPORTS RELATED COMBINED NOISEMAKER AND VISUAL DISPLAY DEVICE

This application claims the benefit of Provisional application Ser. No. 60/159,468, filed Oct. 13, 1999.

FIELD OF THE INVENTION

The present invention generally relates to noise making devices, and more specifically relates to noise making devices formed to replicate sporting equipment, for use by fans at sporting events.

BACKGROUND OF THE INVENTION

Organized team sports, including football, basketball, baseball, and soccer, have a significant role in modern culture, and sporting events are attended by millions of people each year. Fans who attend sporting events typically do so not just as passive observers, but as participants in the sense of cheering for and encouraging their chosen teams. In addition to verbal cheers and applause, many fans use noise making devices to express their excitement and encouragement. Many fans also choose to express themselves visually, with signs, banners, and other visual symbols which may or may not display their chosen team's logo or colors. It is generally considered that coordinated cheers and visual displays are particularly effective for encouraging the players and encouraging other fans.

Many fans wish to express their support and encourage their chosen teams with noisemakers of one form or another, and rattling noisemakers have become very popular for that purpose. The noisemakers in common use include simple hollow objects such as metal cans or plastic bottles or jugs with a few beads or beans placed in the interior. Although such devices do produce noises, the sounds are poorly projected toward the field, and the home made devices in common use typically lack aesthetic qualities. Further, they fail to provide any coordinated visual encouragement to the team.

Rattling noisemakers for other purposes, such as baby rattles, are well known and have been used for many years, and are often decorated with images of various kinds. However, for various reasons, such devices are not well suited for use at sporting events. Further, the emission of sound from the body of those rattles is omni-directional, and it is more desirable for the sound produced by noisemakers at sporting events to be generally directed toward the field rather than in all directions.

SUMMARY OF THE INVENTION

The present invention provides a combined noise maker and visual display device that can be produced efficiently and made readily available to sports fans very economically. The device of the invention may be produced and provided in a variety of configurations, selected to replicate equipment used in a selected sport, such as a football helmet, a baseball batting helmet or bat or ball, a basketball, or a soccer ball, as non-limiting examples. The device may be produced in different colors to match selected team colors, and will readily receive decals or other application of team logos, slogans, etc. as desired. The various configurations of the device of the invention provide a surface of relatively large area to which colors, decals or other displays may be applied, so the display will be highly visible and readily identifiable from a distance.

The physical structure of the device of the invention generally comprises a hollow body formed of a substantially rigid material, a plurality of small beads or pellets loosely disposed in the interior of the hollow body, and a handle means connected to or integral with the body, configured and dimensioned to facilitate holding and the manipulating the device by a user. The body of the device and the handle means are formed in a configuration to closely replicated the outside visual appearance of a selected item of sporting equipment, with the handle being either a replication of a part of the actual item of equipment or being disposed so as to minimize any alteration the configuration of the actual item of equipment needed to provide a handle means.

The body of the device, being typically formed in the shape of a helmet or a ball, has a rounded or curved wall surrounding the hollow interior. A partition of generally planar configuration is disposed within the interior of the body, closing the interior in the case of a helmet configuration, and dividing the interior in the case of a ball configuration. The beads or pellets are confined in the chamber formed between the partition and the wall of the body. The partition is disposed in the body relative to the position of the handle means to form a funnel-like, or megaphone-like chamber expanding in volume from the intersection of partition and wall nearest the handle means outwardly from the user and toward the field of play. Because of that configuration, when the device is shaken back and forth more sound is produced in the portion of the chamber nearest the field of play, and the sound produced within the chamber is at least partially reflected and channeled toward the field of play. As a result, the sound volume projected toward the field of play is higher than the volume of sound projected in the opposite direction.

The structure and features of the device of the invention are described in more detail below, with reference to the accompanying drawing figures.

DETAILED DESCRIPTION OF PREFERRED AND ALTERNATIVE EMBODIMENTS

Figure 1:
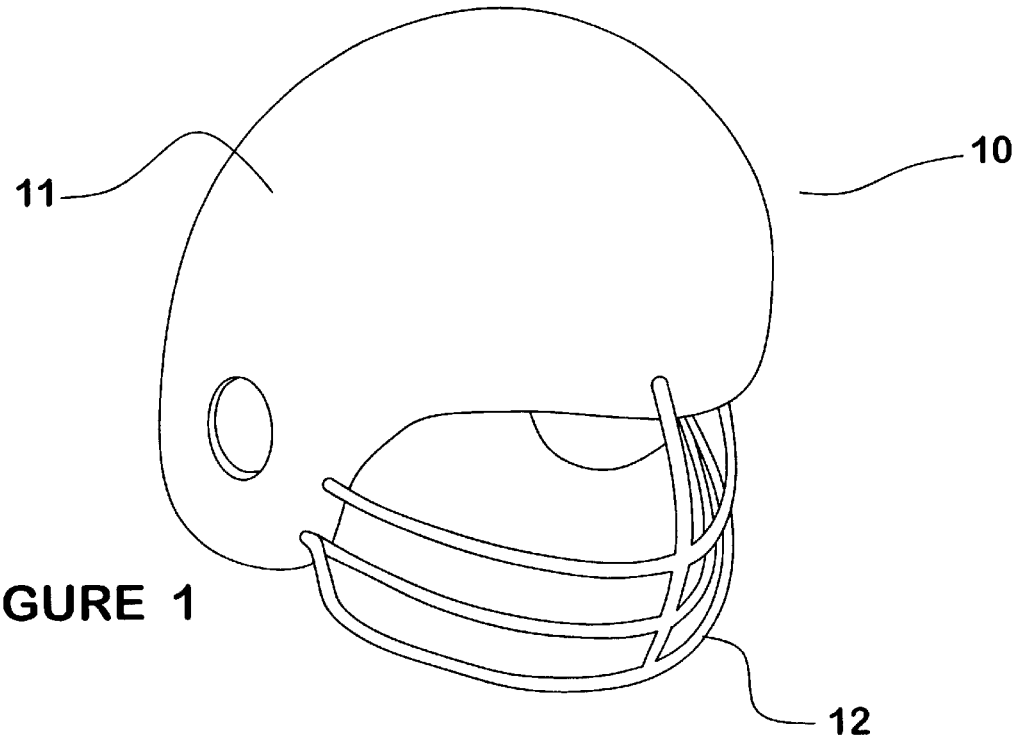
FIG. 1 is a left front perspective view of an embodiment of the device of the invention configured to replicate a football helmet.
Figure 2:
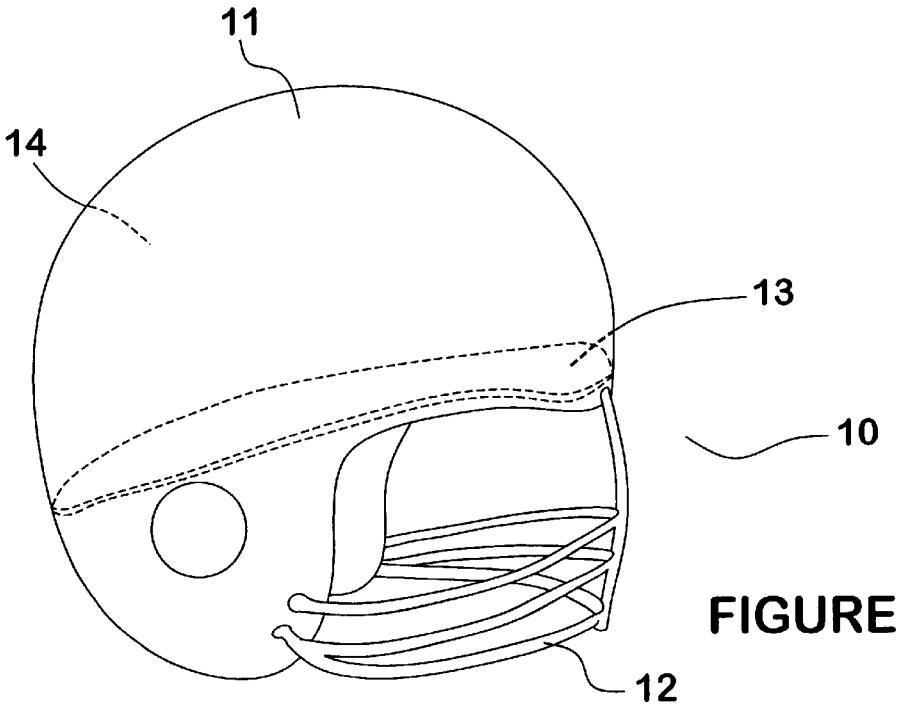
FIG. 2 is a side elevation view of the embodiment of the device of the invention shown in FIG. 1.
Figure 5:
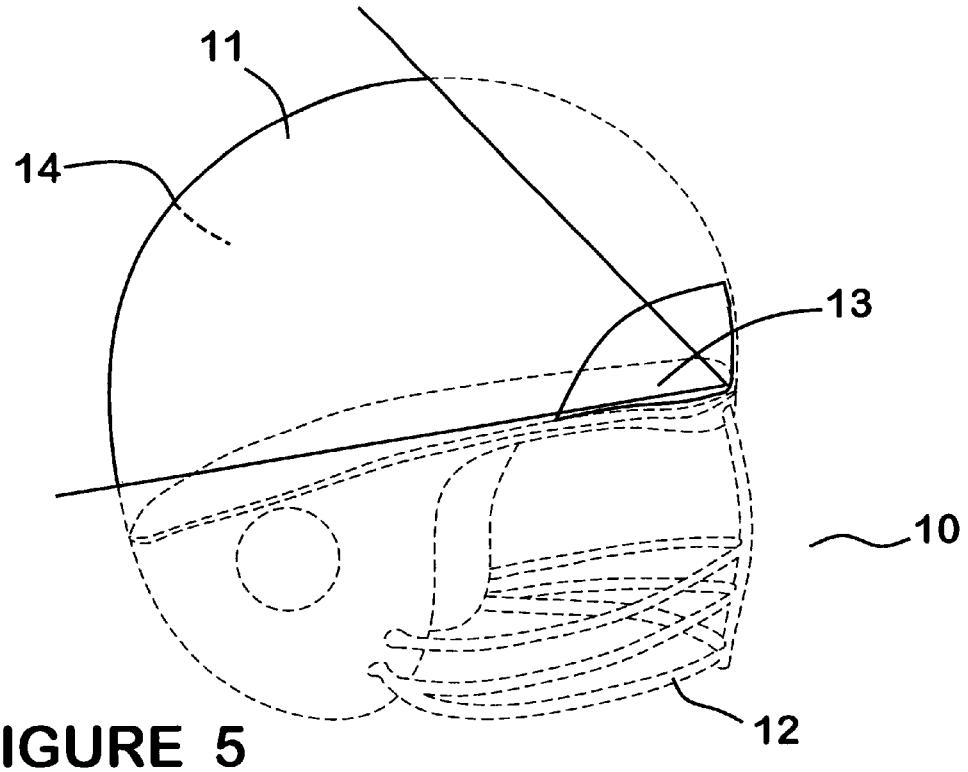
FIG. 5 is a side elevation view of the device in football helmet configuration, as in FIG. 2, shown in phantom view, with lines and arcs added to illustrate the surface area relationships within the pellet chamber.
Figure 6:
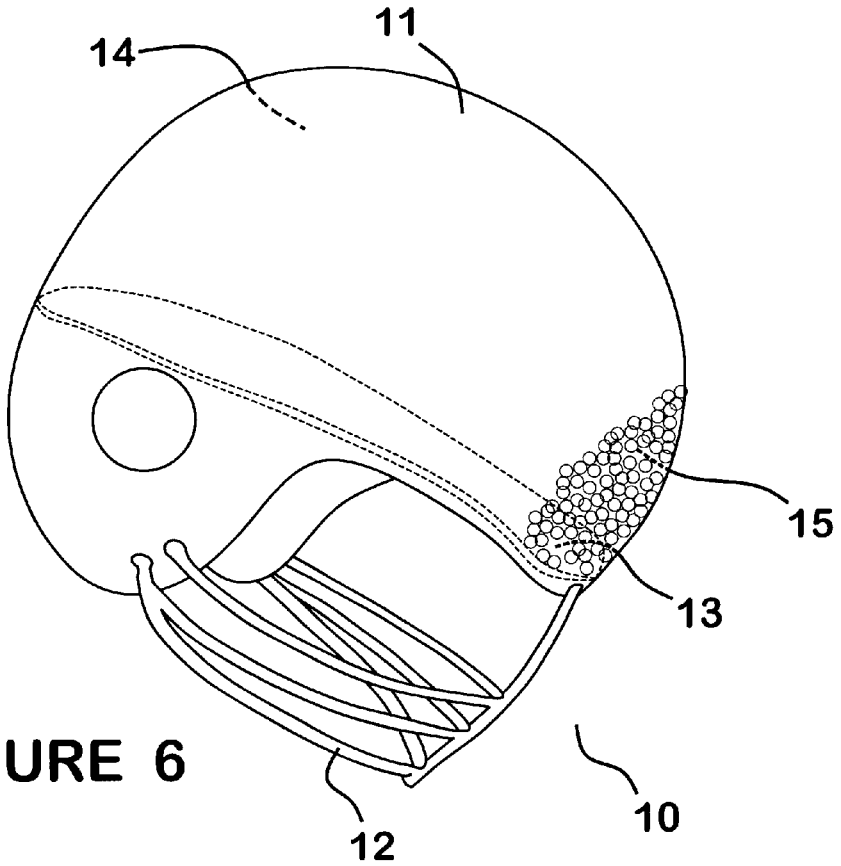
FIG. 6 is a side elevation view of the device in football helmet configuration, as in FIG. 2, oriented to show the position of pellets in the rearward extension of a shaking motion.
Figure 7:
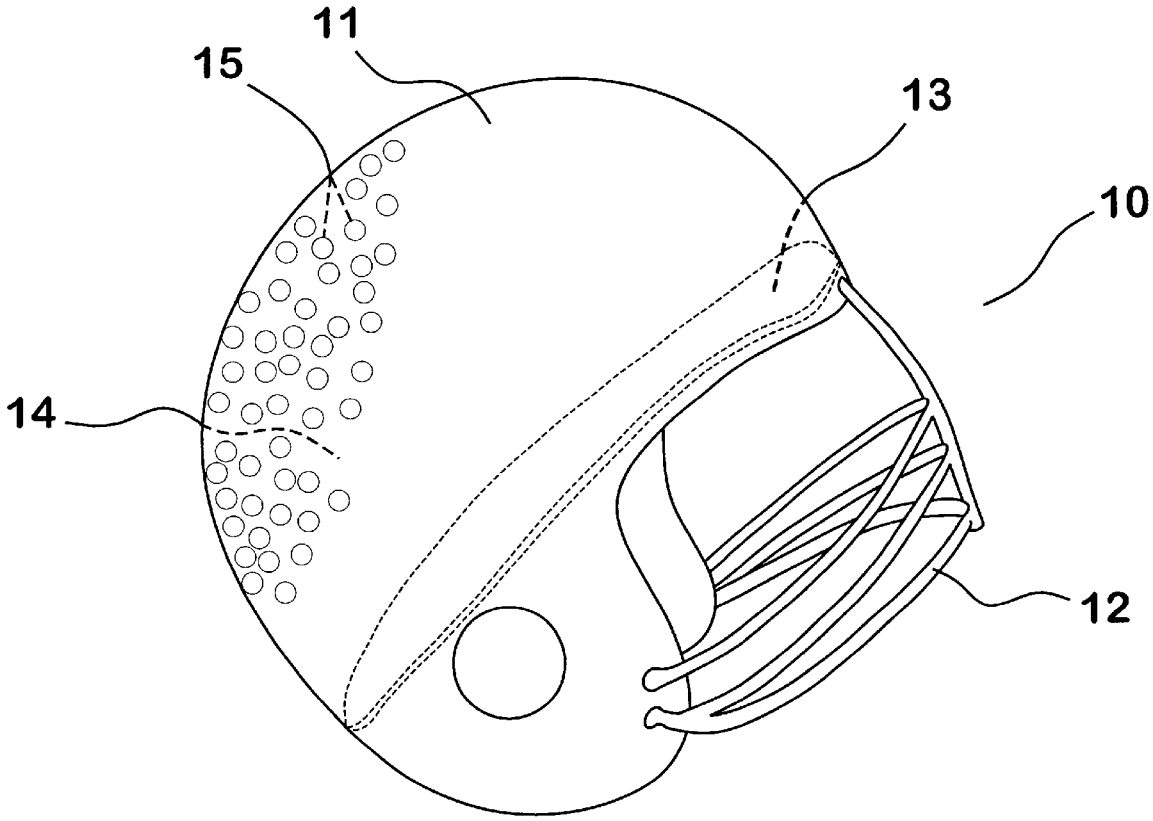
FIG. 7 is a side elevation view of the device in football helmet configuration, as in FIG. 2, oriented to show the position of pellets in the forward extension of a shaking motion.

Referring now to the drawing figures, FIGS. 1 through 3 and 5 through 7 illustrate a device formed to replicate the appearance of a football helmet. As seen in FIGS. 1 and 2, the device, generally designated by reference number 10, includes a main body 11 and a face mask 12. In the football helmet embodiment of the device, the face mask 12 functions as the handle means, and may be grasped in one hand by a user to hold and shake the device. Like an actual football helmet, body 11 is formed with a thin shell or wall extending around a hollow interior, but unlike a functional helmet, which has an open interior so the helmet can be placed on the head of a player, the majority of the body of the device of the invention is closed by partition 13 to form an isolated hollow interior 14. Partition 13 is preferably formed of a hard, rigid, sound reflecting material. The facemask portion of the helmet, comprising handle means 12, is connected to body 11, disposed as shown in the drawing figures. A plurality of small, hard beads or pellets 15 are disposed in hollow interior 14. In the football helmet embodiment a user will grasp the device by placing his hand around the facemask handle means, which will position the device with partition 13 between the user's hand and the interior of the body, which will position the device with the back of the helmet facing toward the field of play. As the body of the device is abruptly moved or shaken the beads repeatedly impact against the inner surface of the wall of the body, with each impact producing sound. The hollow interior of the body is divided by the partition into a funnel-like chamber, with the narrower end of the chamber at the intersection between the partition and the wall nearest the handle means and the wider end of the chamber associated with the portion of wall of the body opposite that intersection, as indicated in FIG. 5. Because of the placement of the handle means and the orientation of the partition, the wider portion of the chamber, and the larger surface area for particle impact, is on the back of the helmet and thus oriented toward the playing field. As the device is shaken back and forth the pellets move back and forth within the chamber. When the device is moved back toward the user the pellets congregate in the narrower portion of the chamber, as shown in FIG. 6, and some of the impacts are between pellets rather than between pellets and the wall or partition, producing a lower sound volume. When the device is shaken forward the pellets are thrown toward the portion of the chamber with a larger volume and larger wall surface area. The pellets spread as they travel through the chamber and impact a larger surface area, as shown in FIG. 7, with more impacts between particles and wall, to produce a higher sound volume. A portion of that sound is projected outwardly from the wall and directly toward the playing field. Another portion of the sound is projected back into the chamber. The sound waves within the chamber, which are compression waves in the air confined therein, encounter the inner surface of the wall and of the partition, from which reflection occurs. The internal sound wave reflections result in projection of a portion of the originally inwardly directed sound out through the wall of the body toward the playing field, increasing the total sound volume projected in that direction. The chamber formed by the partition and the wall of the body thus acts like a megaphone to focus and channel sound in the desired direction.

The back of the helmet, which will face toward the field of play when the device is used as described, provides a relatively large surface area for the visual display of team colors, logos, or the like. Visual displays may be provided by coloring the material of construction of the body, by painting the exterior surface of the body wall, or by affixing decals or stickers to the exterior surface of the body wall, as a few examples. Paint and/or decals could be applied to the body during manufacture of the device, paint or decals could be provided in the packaging for the device for application by the user, or the selection and application of paint and/or decals could be left fully to the user.

It is preferred that the components of the device, and particularly body 11 and partition 13, be constructed of a hard rigid plastic material suitable for molding. When handle means 12 is formed as a separate component, as is contemplated in the case of a football helmet or other helmet designs for example, that component could be formed of the same material as the body and partition, or could be formed of a somewhat more resilient or cushioned material. In either event, the handle means must be sufficiently strong and rigid to function as a secure handle and allow a user to make abrupt changes in the direction of movement of the device.

Figure 3:
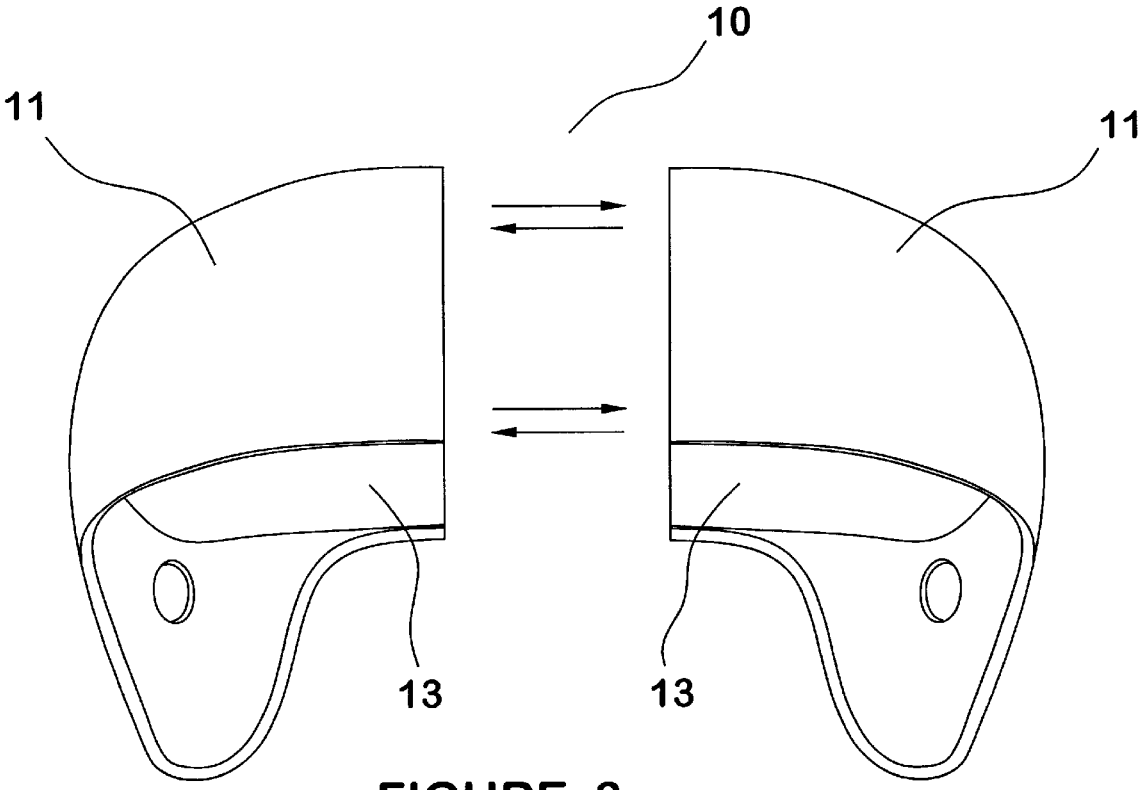
FIG. 3 is a front view of the football helmet configuration of the device of the invention, without facemask, prior to assembly.

In the preferred construction of the device illustrated in FIG. 3, body 11 and partition 13 are formed as two mirrored components each comprising half of the combined body and partition structure. The handle means of at least the helmet configuration is formed as a third component (not shown in FIG. 3). The device of the invention may be fully assembled as a manufacturing step and provided to users ready to use, or may be packaged for sale to users before the components are joined to assemble the completed device. Packaging in this manner, essentially in kit form, allows the body components to be nested and the handle component and a package of beads nested into the body components, making a smaller package size. Final assembly of the kit form of the device by a user involves the simple steps of opening the package of beads and pouring the beads into one of the body components, attaching the second body component to the first to close the body and contain the beads, and attaching the handle means to the body. Paint and/or decals could then be applied by the user if desired, and if not previously applied during manufacture. Small hard items such as BBs, dried peas, or dried beans, could be selected by a user to supplement or replace beads supplied with the device, if desired.

Figure 4:
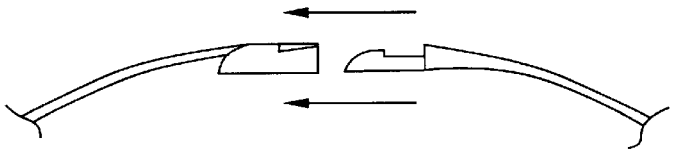
FIG. 4 is a side view of an embodiment of connector means suitable for use in the construction of the device of the invention.

To facilitate assembly, it is preferred that the body components be formed with "snap lock" mechanical connectors along the mating edges of the components. One embodiment of such a connector system is generally illustrated in FIG. 4. In the illustrated embodiment, each connector pair comprises a recess or aperture formed in one component, with a mating stud formed on the other component, so that the stud of each connector pair is inserted and locked into the mating recess. The handle means is then attached to the assembled body using similar connector means. Such connector systems are known in the art, and any convenient secure connector design could be utilized. Alternatively, the body components and/or the handle component could be joined by other means, such as gluing, but the mechanical connector design is preferred as the most convenient.

Although division of the body and partition as described above may be preferred, it is recognized that other manufacturing and assembly approaches could be used. For example, the body could be formed as a single component and the partition formed as a separate component to be fitted into and connected to the body component after the beads are placed in the hollow interior of the body. Attachment of the partition to the body in this alternative approach could be accomplished mechanically, which would be preferred, or by gluing the partition in place. As another example, the body and partition could be formed as a single component, utilizing a manufacturing technique such as blow molding, with an aperture in, e.g., the partition through which the pellets would be placed in the hollow interior of the otherwise closed body structure. A plug would then be used to close the aperture and seal the interior of the body.

Figure 8:
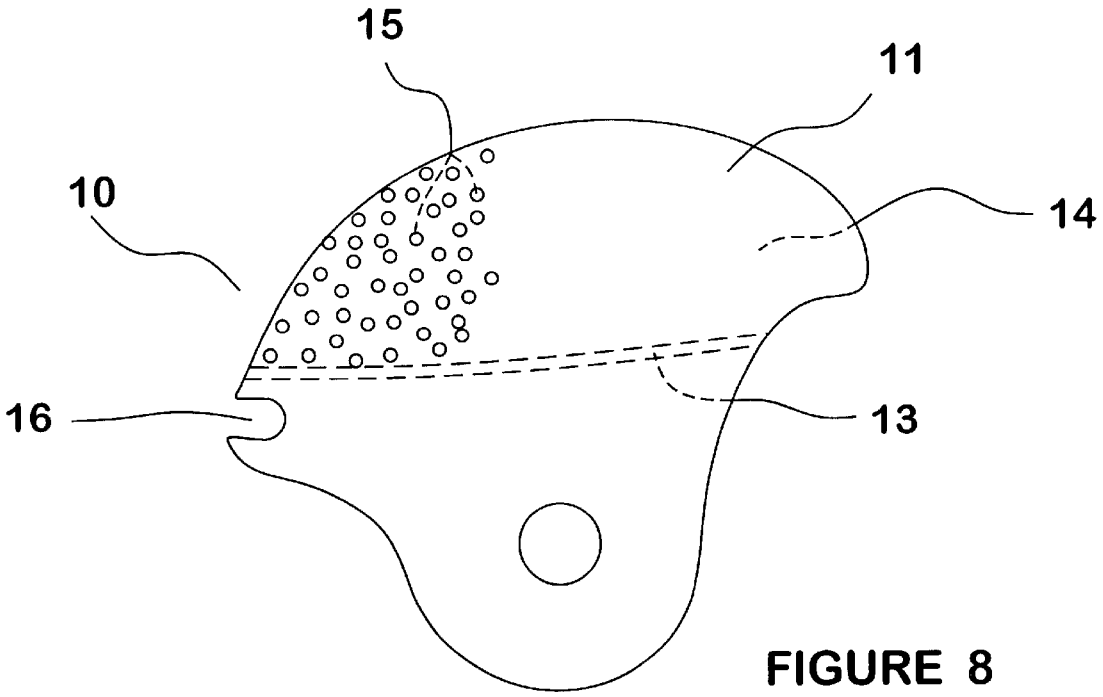
FIG. 8 is a side elevation view of a baseball batting helmet configuration of the device of the invention.
Figure 9:
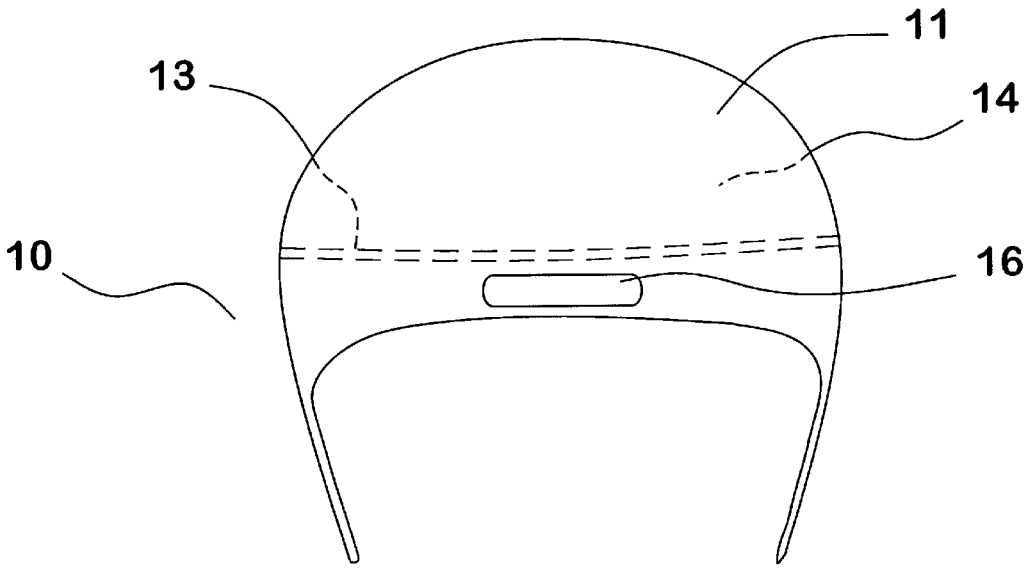
FIG. 9 is a rear elevation view of the baseball batting helmet configuration of the device.

The foregoing description and the drawing figures referred to in that description are focused on the football helmet configuration of the device of the invention, but, as noted above, the concept of the invention is by no means limited to that configuration. A variety of other configurations may be used within the scope of the invention, and non-limiting examples of other configurations are shown in others of the drawing figures. The device can be configured to replicate other types of helmets used in sporting events, such as a hockey goal tender's helmet or a baseball batting helmet. The construction and manner of use of a goal tender's helmet is very similar to the football helmet configuration, since the goal tender's helmet also includes a face mask that serves well as a handle means. A baseball batting helmet, as shown in FIGS. 8 and 9, does not include a facemask, however, so the structure of the noise making and visual display device is modified to provide a handle means. With the batting helmet, the partition is disposed inwardly from the edge of the body wall, and a slotted aperture 16 is provided in the body wall at, e.g. the rear of the helmet structure, extending through the wall between the edge thereof and the partition. A user grasps the device by inserting his fingers through the aperture and around the edge of the body wall. The edge of the aperture may be rounded or padded for comfort, if desired.

Figure 10:
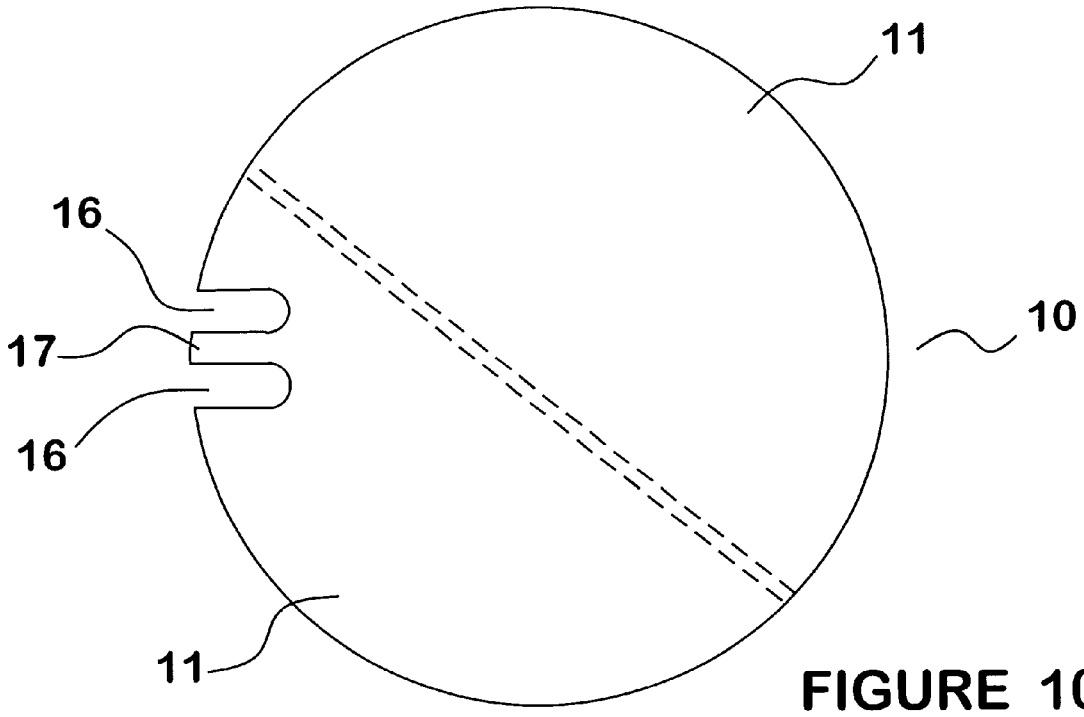
FIG. 10 is a side elevation view of a basketball configuration of the device of the invention.
Figure 11:
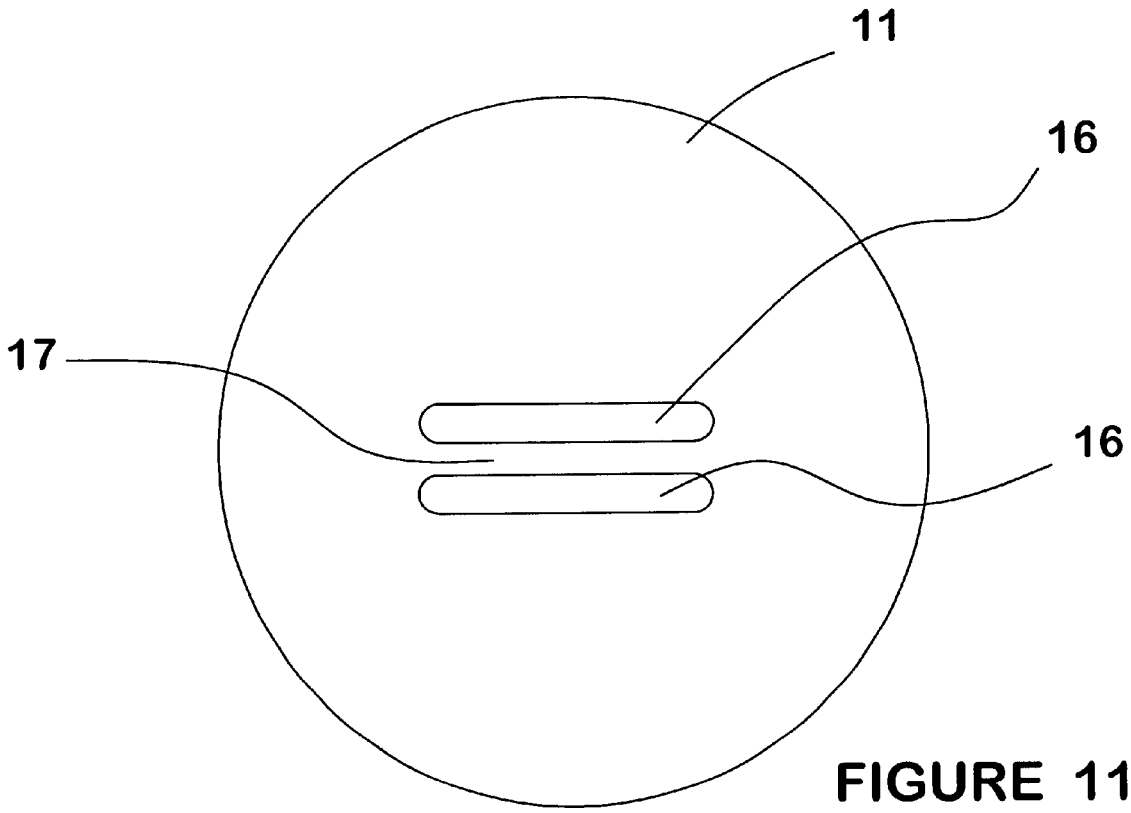
FIG. 11 is a rear elevation view of the basketball configuration of the device.

When the item of sporting equipment to be replicated by the device of the invention is configured as a ball, such as the basketball illustrated in FIGS. 10 and 11, with a closed body and no exposed edge, another approach must be used to form the handle means. As shown in FIG. 10, the partition is placed to divide the interior of the body into a first portion, in which the beads are disposed, and a second portion without beads. The handle means is formed by a pair of slotted apertures 16 disposed in parallel relation and extending through the wall of the body into the second portion of the interior. The portion of the body wall between apertures 16 forms bar 17. The device may be grasped by inserting a user's fingers through one of the apertures, around the bar, and out through the other aperture, so that the fingers grasp the bar to hold the device. The edges of the apertures defining the bar may be rounded or padded for comfort. Although not shown, it should be understood that in any configuration of the device replicating an item of equipment without a facemask or other component to function as a handle, a handle could be connected to the exterior surface of the body wall to extend outwardly from the wall in the desired location. An external handle is not preferred, but could be used within the scope of the invention.

It will be understood that the orientation of the partition relative to the handle means in these, and other, alternative embodiments produces the same focusing and channeling of sound from the device as described above in the context of the football helmet embodiment.

The foregoing description of preferred and certain alternative embodiments of the device of the invention is intended to be illustrative and not limiting. Various other alternative embodiments and modifications could be made to the device of the invention within the scope of the invention, which is intended to be broadly encompassed by the following claims.

What is claimed is:

1. A sports related noisemaker and visual display device, comprising a rigid body having a wall surrounding a hollow interior;

a rigid partition, having a center and an outer edge, disposed in said interior and connected at said outer edge to said wall so as to form a chamber within said interior of said body, said chamber having a periphery immediately adjacent to the intersection of said partition and said wall;

a plurality of hard pellets disposed loosely in said chamber; and handle means disposed on said body outside said chamber, for the purpose of shaking said body so as to cause said pellets to move back and forth in said chamber and produce sound upon impact with said wall and said partition, said handle means disposed near a portion of said periphery of said chamber adjacent to said outer edge of said partition and offset from said center of said partition.

2. The sports related noisemaker and visual display device of claim 1, wherein the volume of the portion of said chamber occupied by said pellets increases as said pellets move from a position in said chamber nearest said handle means across said chamber in response to movement of said body by said handle means.

3. The sports related noisemaker and visual display device of claim 2, wherein said handle means has a center point, wherein said shaking of said body is in an arc within a plane extending through said center point of said handle means and said center of said partition, and wherein said sound is projected from said chamber predominantly in the direction of increase in said volume.

4. The sports related noisemaker and visual display device of claim 1, wherein said handle means is disposed relative to said partition and said wall such that the portion of said chamber extending away from said handle means increases in cross-sectional area from nearest said handle means to the portion of said wall impacted by said pellets moving away from said handle means across said chamber in response to shaking of said body.

5. The sports related noisemaker and visual display device of claim 1, wherein said body is configured to replicate the appearance of a football helmet, and wherein said handle means is configured to replicate a face mask on said football helmet.

6. The sports related noisemaker and visual display device of claim 1, wherein said body is configured to replicate the appearance of a basketball.

7. The sports related noisemaker and visual display device of claim 1, wherein said body is configured to replicate the appearance of a baseball batting helmet.

8. In a noisemaker having a body with a wall extending around a hollow interior, having a partition with a center and an outer edge, the partition extending across the hollow interior of the body and interconnected at its outer edge to the wall to form a closed chamber, a plurality of hard pellets disposed in the chamber for producing sound when the noisemaker is shaken, and a handle on the body for shaking the noisemaker, the improvement comprising positioning the handle of the noisemaker near the outer edge of the partition offset from the center of said partition and in non-symmetrical relation to the chamber, such that said chamber extends in an expanding funnel-like configuration from the point in said chamber nearest said handle.

9. The improvement of claim 8, wherein said funnel-like configuration of said chamber causes sound produced in said chamber to be projected from said chamber away from said handle in the direction of expansion of said chamber.

10. The improvement of claim 8, wherein said body is configured to replicate the appearance of an article of sporting equipment.

11. The improvement of claim 10, wherein said article of sporting equipment is a football helmet.

* * * * *